US006341961B1

(12) United States Patent
Juntwait

(10) Patent No.: US 6,341,961 B1
(45) Date of Patent: Jan. 29, 2002

(54) RADIO FREQUENCY CONNECTOR TO PRINTED CIRCUIT BOARD ASSEMBLY USING AN INSERT-MOLDED LEAD FRAME ASSEMBLY

(75) Inventor: Eric Juntwait, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/775,414

(22) Filed: Jan. 31, 2001

(51) Int. Cl.[7] ..... H01R 12/00
(52) U.S. Cl. ..... 439/63; 439/579; 439/581
(58) Field of Search ..... 439/63, 581, 579, 439/541.5

(56) References Cited

U.S. PATENT DOCUMENTS 6,053,744 A * 4/2000 Gray et al. ..... 439/63
6,132,244 A * 10/2000 Leeman et al. ..... 439/63

* cited by examiner

*Primary Examiner*—Tho D. Ta
(74) *Attorney, Agent, or Firm*—Wei Te Chung

(57) ABSTRACT

A radio frequency connector assembly has a die cast housing (1), a plurality of RF coaxial contacts (2) and two insert-molded lead frame assemblies (3). The die cast housing includes a pair of side walls (10) each forming a row of solder tabs (100) at a lower end thereof, a front wall (11) and a rear wall (13) defining a plurality of passageways (130, 131). The lead frame assemblies are made by insert molding contacts (300, 301) into a plastic portion (31). The lead frame assemblies are installed in passageways of the die cast housing. Tabs (133, 134, 140, 141) in the die cast housing are pressed down to hold the lead frame assemblies in place. The lead frame assemblies located within corresponding passageways (130, 131) in the die cast housing are optimized for a specific impedance.

12 Claims, 8 Drawing Sheets

RADIO FREQUENCY CONNECTOR TO PRINTED CIRCUIT BOARD ASSEMBLY USING AN INSERT-MOLDED LEAD FRAME ASSEMBLY

FIELD OF THE INVENTION

The present invention relates to a radio frequency (RF) connector assembly having an insert-molded lead frame assembly for connecting RF coaxial contacts to a printed circuit board (PCB).

BACKGROUND OF THE INVENTION

U.S. Pat. No. 6,053,744 utilizes a two-step moulded interconnect device (MID) molding process where radio frequency (RF) connectors are connected to the PCB with plated plastic. The adapter in the U.S. Pat. No. 6,053,744 Patent comprises a plastics body which has a plated body area, a plated through hole and solder tabs connecting the plated body area to be directly connected to traces on a PCB. An electrical contact attains an interference fit with the plated through hole, providing a first electrical signal path communicating between the contact and the plated through hole to the solder tab. An outer shell of the RF connector would mate with a connector interface of the adapter, providing a second electrical signal path communicating between the outer shell of the RF connector and solder tabs via the plated body area and the connector interface. The first and second signal paths could then be connected to the PCB by the soldertabs respectively.

However, this is a very complicated and expensive product, which will produce high levels of production scrap and long lead times.

Hence, an improved RF connector is needed to overcome the above-mentioned deficiencies of current RF connectors.

SUMMARY OF THE INVENTION

Accordingly, the primary object of the present invention is to provide a radio frequency (RF) connector assembly having an insert-molded lead frame assembly of which the manufacture can be easily automated.

An RF connector assembly in accordance with the present invention comprises a die cast housing, a plurality of RF coaxial contacts and two insert-molded lead frame assemblies. The die cast housing includes a pair of side walls each forming a row of solder tabs at a lower end thereof, a front wall, and a rear wall defining a plurality of passageways. The lead frame assemblies are made by insert molding contacts into a plastic portion. The lead frame assemblies are installed in passageways of the die cast housing. Tabs in the die cast housing are pressed down to hold the lead frame assemblies in place. The lead frame assemblies located within corresponding passageways in the die cast housing are optimized for a specific impedance.

Other objects, advantages and novel features of the invention will become more apparent from the following detailed description when taken in conjunction with the accompanying drawings.

DETAILED DESCRIPTION OF THE INVENTION

Figure 1:
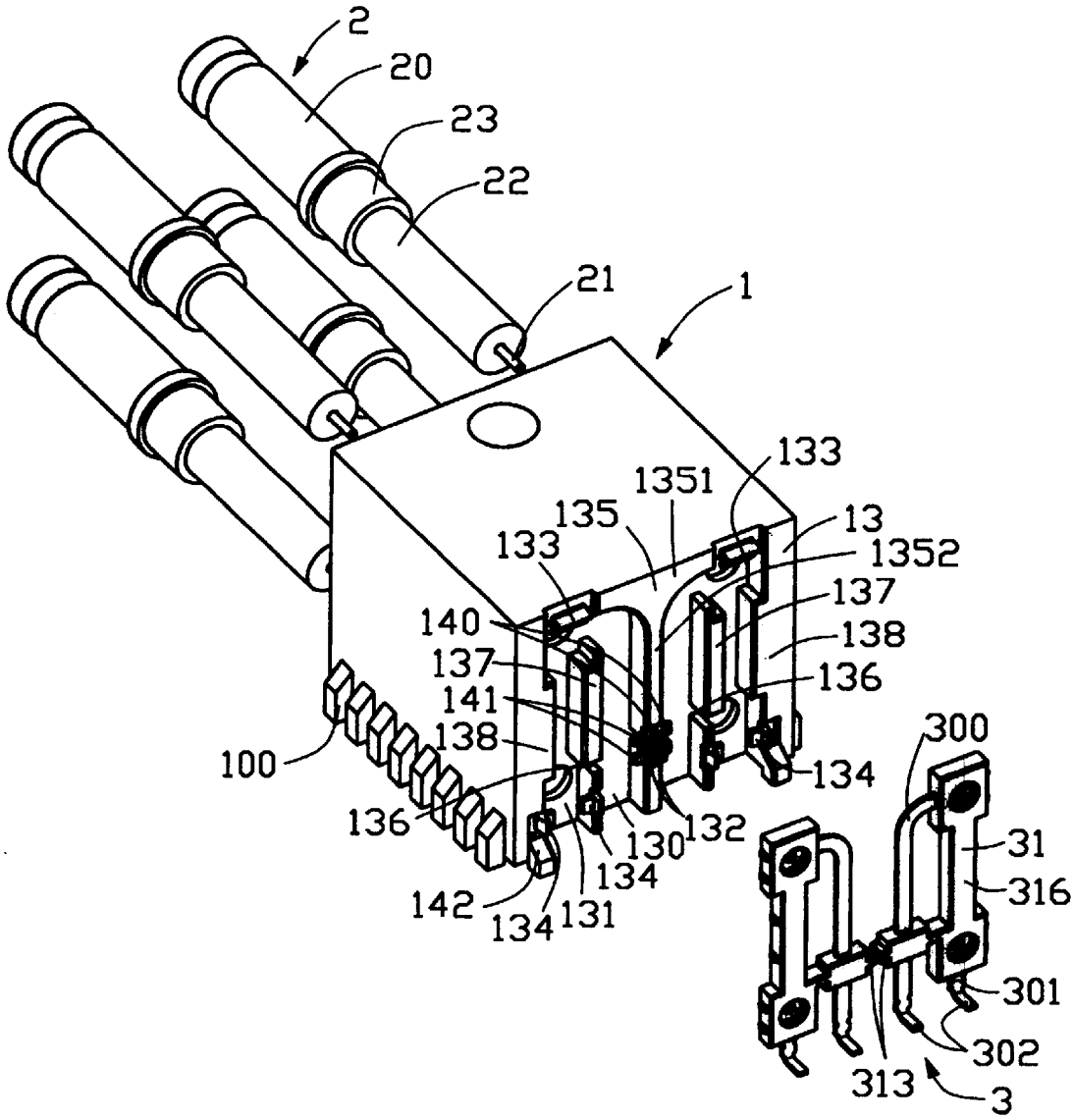
FIG. 1 is an exploded view of a radio frequency (RF) connector in accordance with the present invention.
Figure 2:
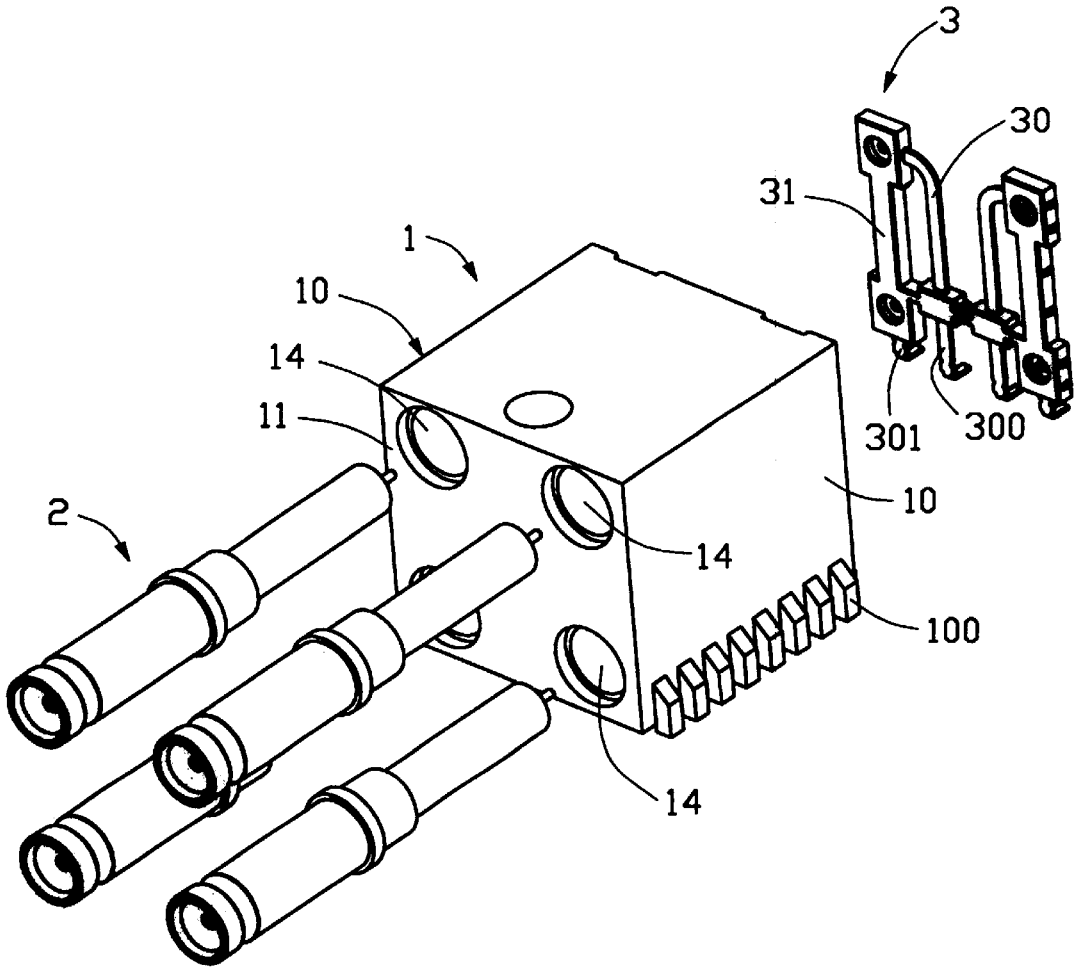
FIG. 2 is a view of the RF connector assembly of FIG. 1 from another aspect.

Reference will now be made in detail to the preferred embodiment of the present invention.

Referring to FIGS. 1–4, a radio frequency (RF) connector assembly in accordance with the present invention comprises a die cast conductive housing 1, four RF coaxial contacts 2 and two lead frame assemblies 3.

The die cast housing 1 includes a pair of side walls 10, a front wall 11 and a rear wall 13. Four stepped, plated through channels 14 extend through the front wall 11 to the rear wall 13. Each side wall 10 forms a row of solder tabs 100 at a lower end.

The rear wall 13 forms a T-shaped part 135 in a middle section thereof, a pair of side parts 138 at two sides thereof and a pair of middle parts 137 between the T-shaped part 135 and the side part 138. The middle parts 137 and the side parts 138 are respectively symmetric about the T-shaped part 135. A rotatable tab 133 is formed beside either end of the horizontal cross arm 1351 of the T-shaped part 135 and above the plated through channels 14. A pair of rotatable tabs 140, 141 is formed on either side of a vertical support arm 1352. Each pair of tabs 140, 141 defines a cutout 132 therebetween, the cutouts 132 being adjacent to each other. Each middle part 137 and each side part 138 forms a rotatable tab 134 at a bottom section thereof. A pair of gaps 136 is defined in the middle part 137 above the corresponding tab 134 thereon. A pair of solder tabs 142 is rearwardly formed on a lower section of the rear wall 13 adjacent the corresponding side part 138.

The rear wall 13 defines a pair of die cast inner passageways 130 immediately adjacent either side of the support arm 1352 of the T-shaped part 135 and a pair of die cast outer passageways 131 parallel to the inner passageways 130 but further from the support arm 1352. The inner and outer passageways 130, 131 merge at their respective upper ends (not labelled) and communicate with the plated through channels 14 of the die cast housing 1, with the gaps 136 and with the cutouts 132.

Each RF coaxial contact 2 includes an inner conductor 21, an outer conductor 20 surrounding the inner conductor 21 and an insulator 22 insulating the outer conductor 20 from the inner conductor 21. The outer conductor 20 includes a knurled area 23 at a rearmost section thereof. The outer conductor 20, the insulator 22 and the inner conductor 21 are successively formed in a longitudinal direction. Since the structure and the function of RF coaxial contacts 2 is well known to those skilled in the art, a detailed description thereof is omitted herein.

Figure 3:
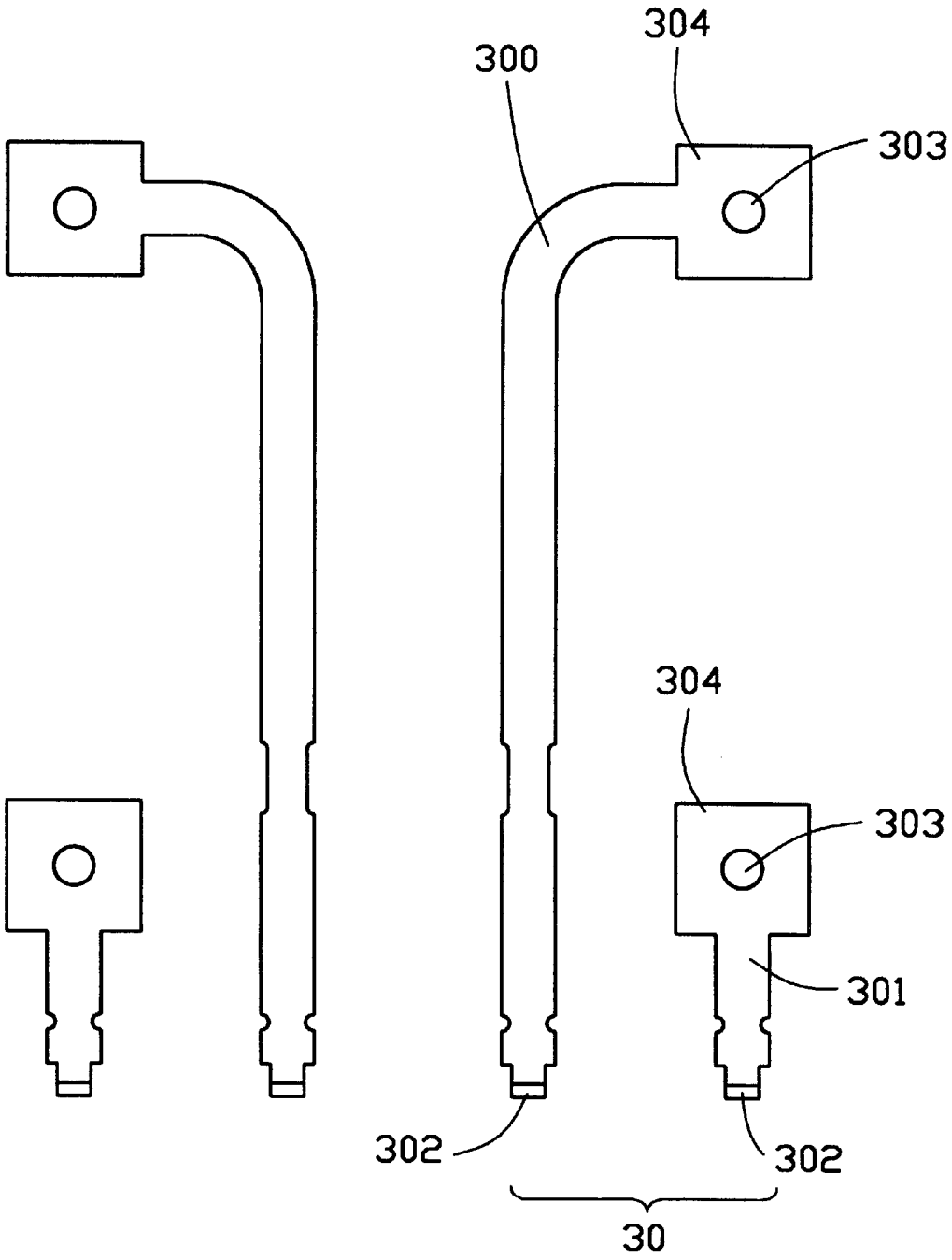
FIG. 3 is a front elevation view of two lead frame assemblies of the RF connector assembly of FIG. 1.
Figure 4:
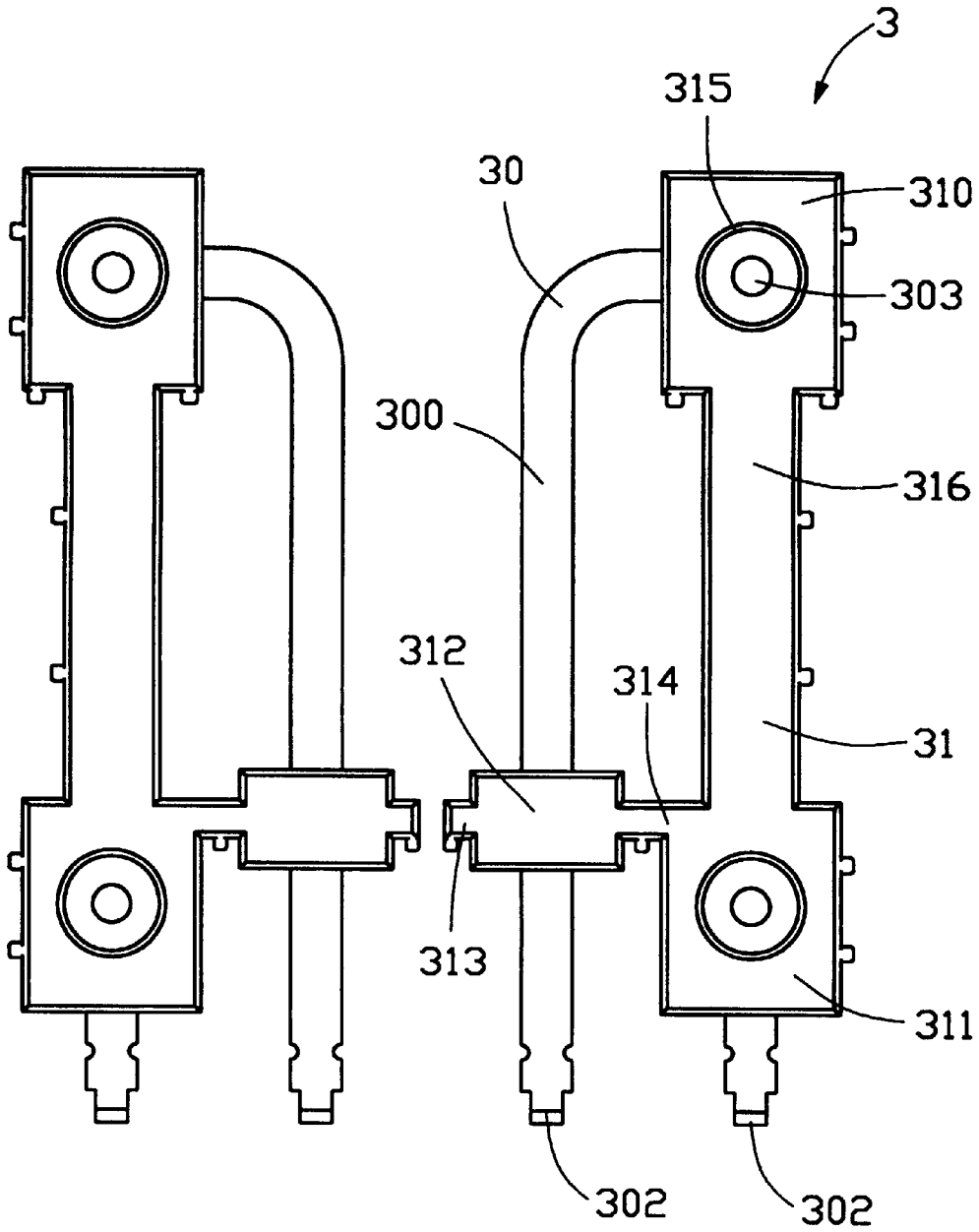
FIG. 4 is an elevational view of two plastic assemblies in which the lead frame assemblies of FIG. 3 are incorporated.

Particularly referring to FIGS. 3 and 4, each lead frame assembly 3 includes a lead frame 30 insert molded in a plastic portion 31.

Each lead frame 30 comprises a long first contact 300 thereof and a short second contact 301. The first contact 300 has a right angle bend at an upper section thereof and the short contact 301 is straight. Each first and second contact 300, 301 has a square end 304 at a top end thereof and a horizontal foot 302. A small hole 303 is defined in a center of each square end 304.

The plastic portions 31 are mirror images of one another. Each plastic portion 31 comprises a rectangular top block 310 and a rectangular bottom block 311, a connecting portion 316 interconnecting the top block 310 with the bottom block 311, a side block 312 and a support portion 314 connecting the bottom block 311 with the side block 312. Each top and bottom block 310, 311 defines a large hole 315 through a center thereof and covers the square end 304 of the corresponding lead frame 30 except where the large holes 315 expose opposite faces of the square ends 304 immediately around the small holes 303 of the long and second contacts 300, 301. The side block 312 is inserted molded around the first contact 300 at a lower section of the first contact 300. The side block 312 outwardly forms a protrusion 313 opposite to the support portion 314. The plastic material of the plastic portion 31 is minimized to optimize the impedance and electrical performance of the first and second contacts 300, 301, and therefore the entire RF connector assembly.

Figure 5:
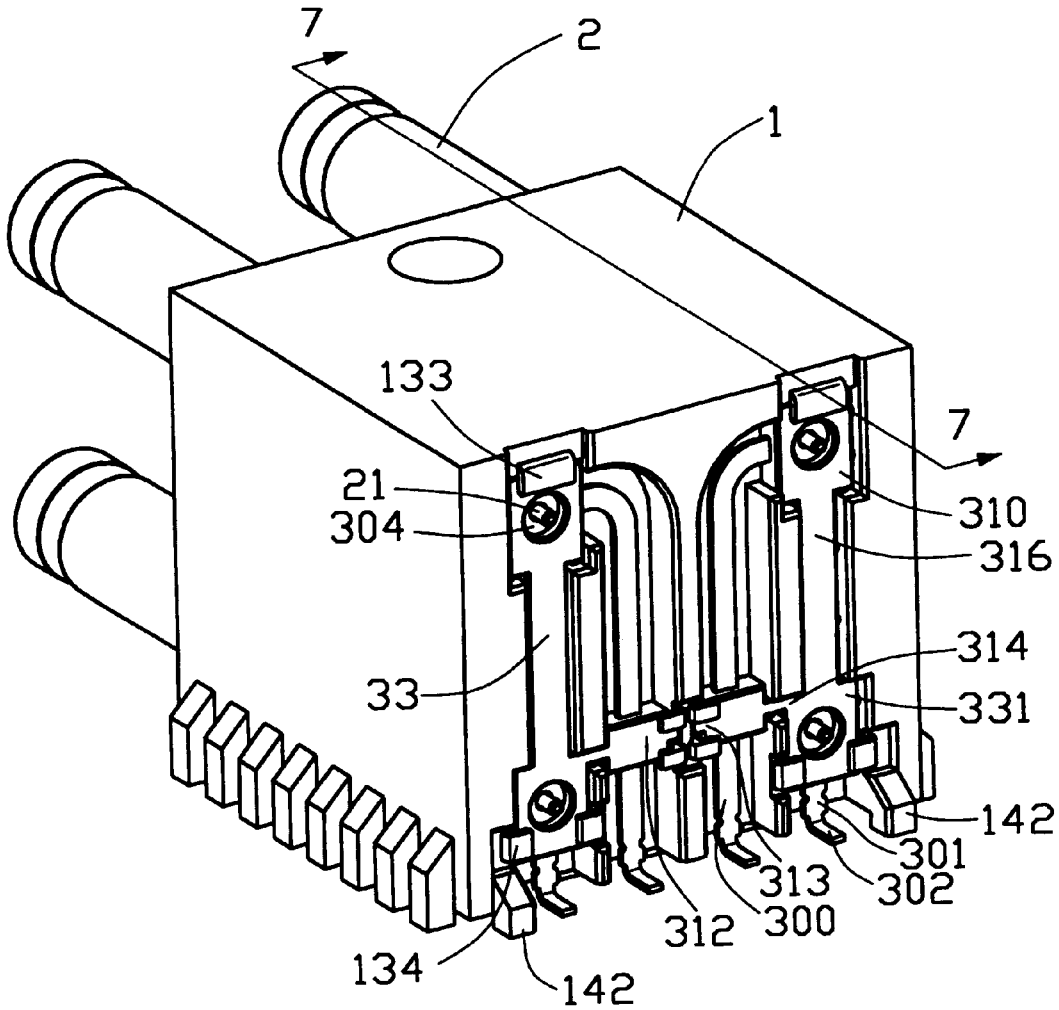
FIG. 5 is an assembled view of FIG. 1.
Figure 6:
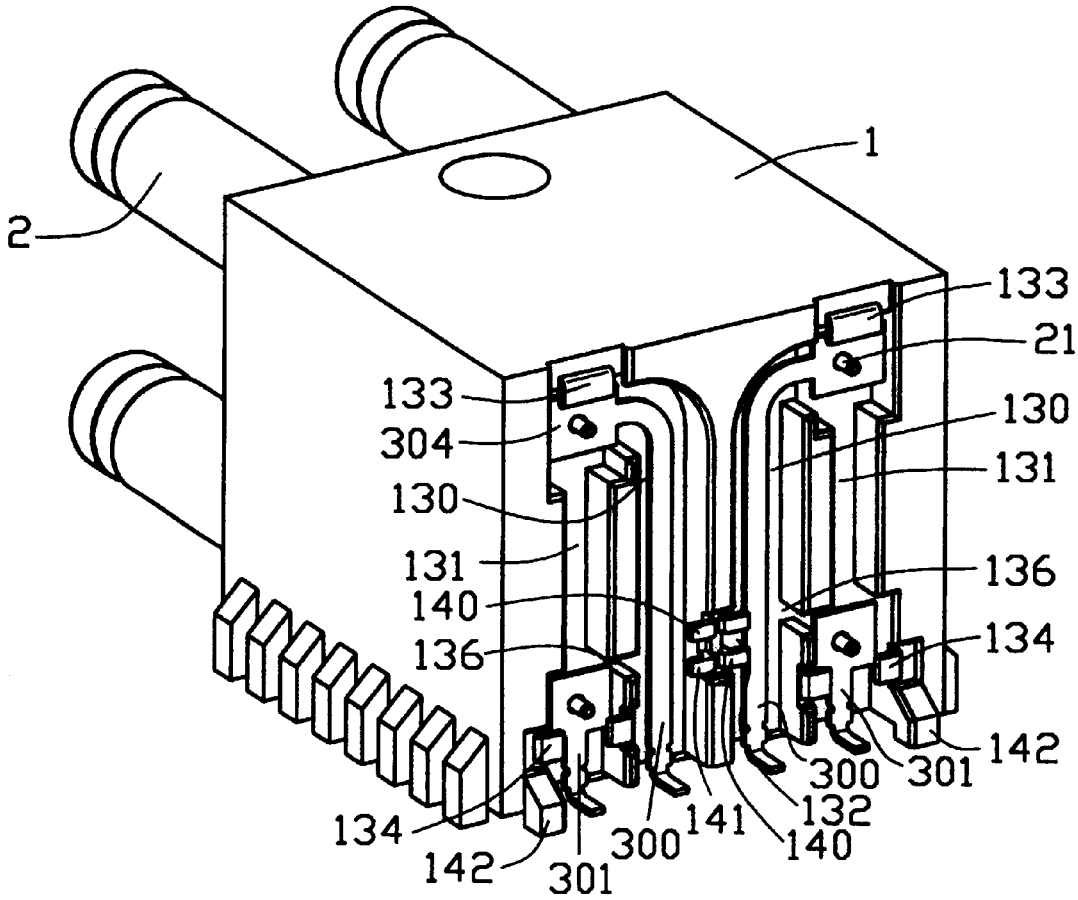
FIG. 6 is similar to FIG. 5, wherein insert-molded plastic assemblies are removed.
Figure 7:
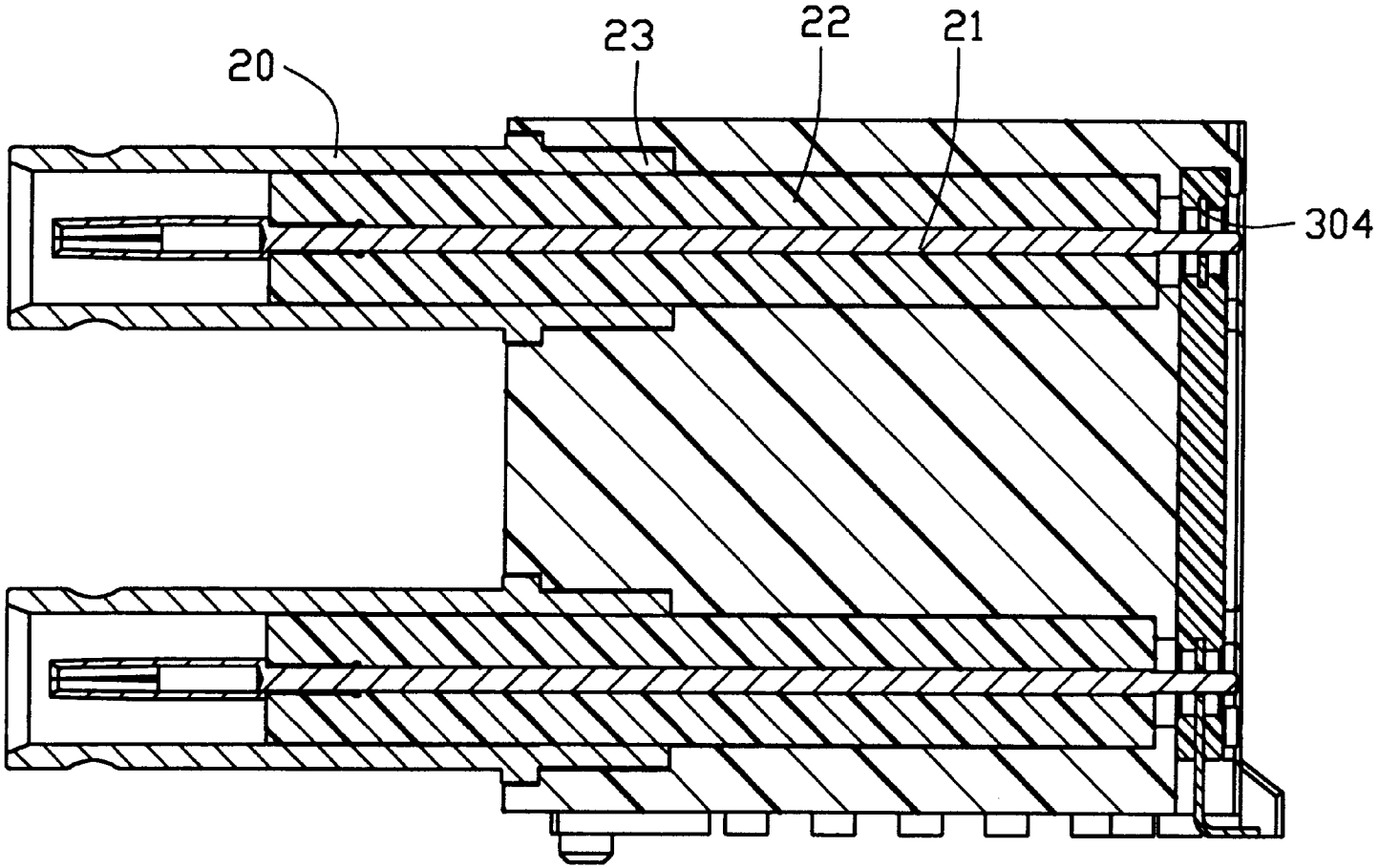
FIG. 7 is a cross-sectional view of FIG. 5 taken along line 7—7 of FIG. 5.

Referring to FIGS. 5–7, in assembly, the RF coaxial contacts 2 are pressed into the plated through channels 14 of the die cast housing 1 until the insulator 22 and the knurled area 23 are received in the channels 14. The outer conductor 20 of each RF coaxial contact 2 electrically connects with the corresponding plated through channels 14 for grounding purposes. The inner conductor 21 is exposed from a rear of the through channel 14 into the corresponding outer passageway 131. Thus the die cast housing 1 surrounds the insulator 22 of the RF coaxial contact 2 to provide uniform impedance.

The lead frame assemblies 3 are inserted into the rear wall 13 of the die cast housing 1. The first contacts 300 are respectively located in the corresponding inner passageways 130 and the two connecting portions 316 and the second contacts 301 are respectively located in the corresponding outer passageways 131 opposite to each other. The large and small holes 315, 303 are aligned with the corresponding plated through channels 14 of the die cast housing 1 and the inner conductor 21 protrudes through the small hole 303 and into a rearward large hole 315 of the lead frame assembly 3. The support portions 314 of the lead frame assemblies 3 are received in the corresponding gaps 136 and the protrusions 313 are received in the corresponding cutouts 132. The first contacts 300 are retained in the inner passageways 130 to maintain impedance control. The lead frame assemblies 3 located within the inner and outer passageways 130, 131 in the die cast housing 1 are optimized for a specific impedance.

The inner conductor 21 of each RF coaxial contact 2 is soldered to the square end 304 of a corresponding first or second contact 300, 301.The tabs 133 are pressed down to firmly engage with the top blocks 310 of the lead frame assemblies 3. The tabs 134, 140 and 141 are pressed down to respectively retain corresponding bottom blocks 311 and side blocks 312 in place.

Figure 8:
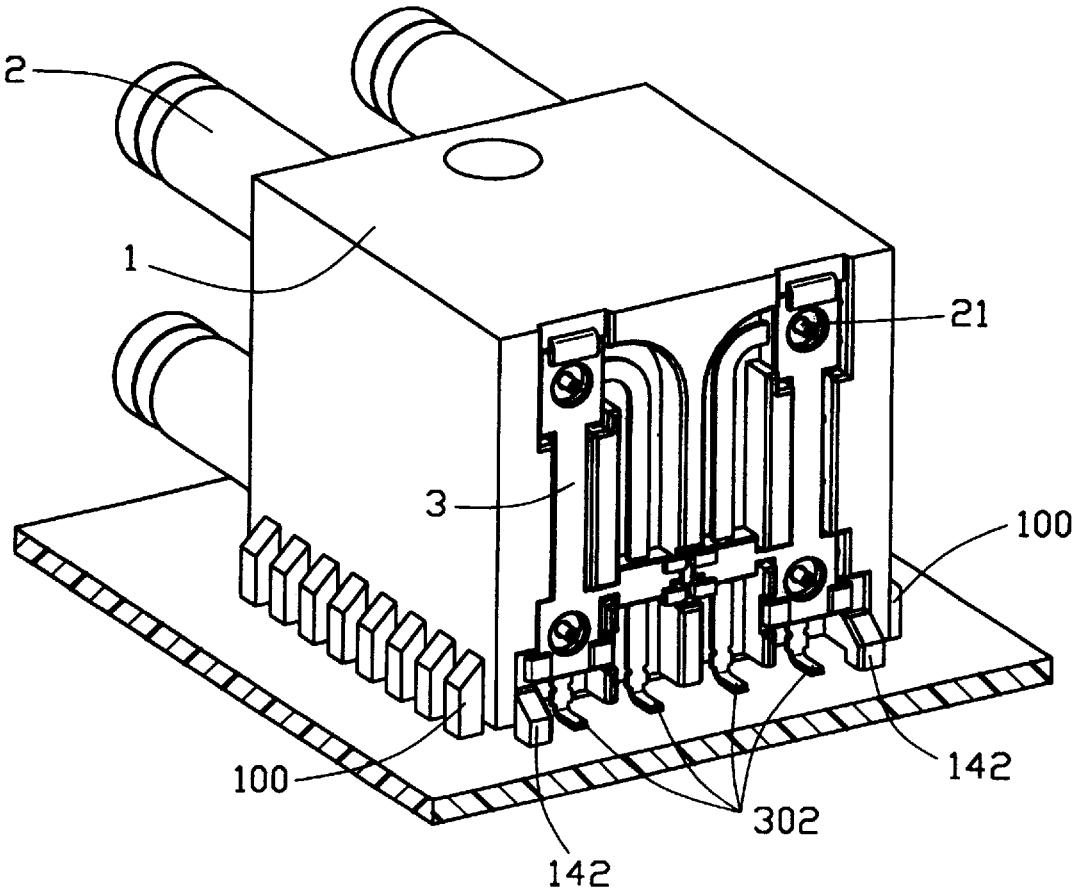
FIG. 8 is an assembled view of the RF connector assembly of the present invention wherein the RF connector assembly is mounted on a printed circuit board (PCB).

Referring to FIG. 8, in use, the solder tabs 100, 142 of the die cast housing 1 and the contact feet 302 of the lead frame assemblies 3 are soldered to a printed circuit board (PCB) (not labeled), so the die cast housing 1 and the inner conductors 21 of the RF coaxial contacts 2 are electrically connected with the PCB (not labeled).

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An electrical connector for mounting on a printed circuit board (PCB) comprising:

a die cast housing defining a plurality of channels through a front wall thereof to a rear wall thereof, and at least one passageway in the rear wall;

a plurality of radio frequency (RF) coaxial contacts received in said channels of said housing, each RF coaxial contact comprising an inner conductor, an outer conductor surrounding the inner conductor and an insulator insulating the outer conductor from the inner conductor; and at least one insert-molded lead frame assembly received in one of the corresponding passageways, each insert-molded lead frame assembly comprising a first and a second contacts, each contact being electrically connected with an exposed end of the inner conductor of a corresponding RF coaxial contact.

2. The electrical connector in accordance with claim 1, wherein the outer conductor, the insulator and the inner conductor are successively exposed in a longitudinal direction.

3. The electrical connector in accordance with claim 1, wherein each channel in the die cast housing is plated for electrically connecting with the outer conductor of the RF coaxial contact.

4. The electrical connector in accordance with claim 1, wherein the die cast housing forms a plurality of tabs along an inner peripheral surface of the at least one passageways for retaining the insert-molded lead frame assembly in the die case housing.

5. The electrical connector in accordance with claim 1, wherein the first contact has a square end defining a hole in a center thereof and the second contact has a square end defining a hole in a center thereof.

6. The electrical connector in accordance with claim 1, wherein each insert-molded lead frame assembly comprises a plastic portion molded around the first and second contacts, and each plastic portion defines a first hole and a second hole respective in communication with the first contact and the second contact of the insert-molded lead frame assembly.

7. An electrical connector for mounting on a printed circuit board, comprising:

a conductive housing defining at least a first through channel extending in a front-to-back direction;

a first coaxial contact received within said through channel, said first coaxial contact including a first inner conductor and a first outer conductor enclosing said first inner conductor with a first insulator therebetween, both said first inner conductor and said first outer conductor extending along said front-to-back direction, said first outer conductor mechanically and electrically engaged with the housing; and a lead assembly attached to a rear portion of the housing, said lead assembly including a plastic portion securing a first lead contact therewith, said first lead contact extending downwardly along said plastic portion for mounting to the printed circuit board thereunder; wherein said plastic portion is retainably secured to the housing, and said first lead contact is mechanically and electrically engaged with a rear portion of the first inner conductor.

8. The connector in accordance with claim 7, wherein said housing further defines a second through channel, and a second coaxial contact is received within said second through channel, said second coaxial contact including a second inner conductor enclosed by a second outer conductor.

9. The connector in accordance with claim 8, wherein said lead assembly further includes a second lead contact secured by said plastic portion, spaced from said first lead contact, and mechanically and electrically engaged with said second inner conductor.

10. An electrical connector for mounting on a printed circuit board, comprising:

a conductive housing defining first and second through channels extending in a front-to-back direction;

first and second coaxial contacts received within said first and second through channels, respectively, each of said first and second coaxial contacts including an inner conductor and an outer conductor enclosing said inner conductor with an insulator therebetween, both said inner conductor and said outer conductor extending along said front-to-back direction, said outer conductor mechanically and electrically engaged with the housing; and a lead assembly attached to a rear portion of the housing, said lead assembly including a plastic portion securing spaced first and second lead contacts therewith, said first and second lead contacts extending downwardly along said plastic portion for mounting to the printed circuit board thereunder; wherein said first and second lead contacts are mechanically and electrically engaged with the corresponding inner conductors of said first and second coaxial contacts, respectively.

11. The connector in accordance with claim 10, wherein said first and second through channels are spatially aligned with each other in a vertical direction of the housing.

12. The connector in accordance with claim 11, wherein each of said first and second lead contacts has a solder foot, and the solder foot of the first lead contact is spatially aligned with that of the second lead contact in a lateral direction of the housing.

* * * * *